US005446236A

United States Patent [19]

Nakada et al.

[11] Patent Number: 5,446,236

[45] Date of Patent: Aug. 29, 1995

[54] MUSICAL TOY

[75] Inventors: Takashi Nakada; Keiichi Kazami, both of Saitama; Shigenori Kuwabara, Tokyo, all of Japan

[73] Assignee: Kabushiki Kaisha B-AI, Tokyo, Japan

[21] Appl. No.: 132,847

[22] Filed: Oct. 7, 1993

[30] Foreign Application Priority Data

Apr. 23, 1993 [JP] Japan ..... 5-120468

[51] Int. Cl.[6] ..... G10F 1/08

[52] U.S. Cl. ..... 84/102; 84/405; 446/298; 446/303

[58] Field of Search ..... 84/102, 103, 104, 105, 84/404, 405, 407; 446/139, 298, 303

[56] References Cited

U.S. PATENT DOCUMENTS 1,564,674 12/1925 Hodgkins ..... 84/404
1,781,927 11/1930 Klein ..... 84/405
5,270,480 12/1993 Hikawa ..... 84/104 X

*Primary Examiner*—Michael L. Gellner
*Assistant Examiner*—Patrick J. Stanzione
*Attorney, Agent, or Firm*—R. Gale Rhodes, Jr.

[57] ABSTRACT

A musical toy has a simple construction and can accurately produce melodies and rhythms without also producing extraneous mechanical noise. A generally doll-shaped body contains two permanent magnets and is fitted with a pair of swinging members each containing an electromagnetic coil disposed so that it faces the permanent magnets. A control device, containing a rhythm signal generator circuit and a control circuit which creates rhythm drive signals based on the signal from the rhythm signal generator circuit, supplies each of the coils with a separate and independent drive signal. A sound producing body is disposed in the swinging path of each swinging member so that when the swinging member is caused by the magnetic interaction between the coil and the permanent magnets to swing in response to the rhythm signal from the control device, the sound producing body is struck by the swinging member and a musical note is sounded.

6 Claims, 5 Drawing Sheets

MUSICAL TOY

BACKGROUND OF THE INVENTION

This invention relates to a musical toy in which a sound producing body is struck by a swinging member which is caused to swing by the magnetic interaction between a permanent magnet and an electromagnetic coil.

DESCRIPTION OF THE PRIOR ART

In recent years various toys which make sounds have been proposed.

In the Japanese Laid-Open Patent Publication No. S.57-84998, a toy monkey holding a cymbal in each hand is described. This toy is shaped like a monkey and has a built-in microphone, a motor, and a drive transmission mechanism which transmits the rotating drive of the motor. When the microphone detects sounds from outside the toy, a starting signal is outputted, the rotating drive of the motor is transmitted by the transmission mechanism to the left and right arms of the toy, and the cymbals held in the monkey's hands are struck against each other. Thus the toy will respond to a sound such as a human voice or a handclap by making a noise by striking the cymbals together. The toy is designed so that it stops operating a predetermined fixed time from when it inputs the sound of its own cymbals.

However, a conventional musical toy of this kind has not produced sounds having any specific melody or tempo, but rather has just made a noise by striking the cymbals together, and the resulting sound has been monotonous. This has given rise to the problem that the listener soon becomes bored of the musical toy.

Also, because conventional musical toys designed to produce sounds having a specific melody or tempo have used a motor and a drive transmission mechanism which mechanically transmits the rotational drive of the motor to produce the sounds, they have had the shortcoming that for a toy to be able to produce subtle melodies it has had to have a complex drive mechanism and the assembly process has been long and complicated.

Furthermore, when gears and cams and so on are used in a drive transmission mechanism for transmitting the rotational drive of a motor, mechanical drive noises are produced. Not only can these mechanical drive noises be grating and uncomfortable to listen to, especially in cases when the toy is heard in a quiet place, they also make it difficult for a subtle melody to be faithfully played.

SUMMARY OF THE INVENTION

This invention is the result of an attempt at solving these problems, and aims to provide a musical toy which does not use any motor or mechanical drive transmission mechanism; which has a simple construction that makes for a simple assembly process; and which can produce sounds having specific melodies and tempos.

Another object of this invention is to provide a musical toy which does not make grating mechanical drive noises, and which can produce subtle melodies accurately and faithfully.

The first of the means which make up this invention has a swinging member pivotally mounted in close proximity to a permanent magnet, and this swinging member is provided with a coil which by magnetically interacting with the permanent magnet causes the swinging member to swing. A control device has a rhythm signal operating means for generating rhythm signals and a rhythm drive signal supplying means for supplying rhythm drive signals to the coil based on the signal from the rhythm signal generating means, and the swinging member swings in response to these rhythm signals and strikes a sound producing body.

Because the sound producing body is struck by the swinging member swinging in response to rhythm signals in this way, sounds having a specific rhythm and tempo can be produced and a fun and interesting device can be made.

Also, because the swinging members are caused to swing just by the interaction of permanent magnets and coils, the toy has a simple construction and the assembly process can also be made simple.

The second of the means which make up this invention has a plurality of toy bodies; a control device; and a plurality of sound producing bodies for producing a plurality of different musical notes.

Swinging members corresponding to the different musical notes are mounted in the toy bodies, and the swinging members are each provided with a coil which causes the swinging member to swing by magnetically interacting with permanent magnets mounted in the toy body. The control device has a melody signal generating means for generating melody signals and a melody drive signal supplying means for supplying a melody drive signal for each musical note, based on the signal from the melody signal generating means, to the coil corresponding to that musical note, and the sound producing bodies are struck by the swinging members swinging in response to the melody drive signals from the control device.

Because, as described above, the sound producing bodies are struck by swinging members swinging in response to melody drive signals, sounds having specific melodies can be produced and a fun and interesting device can be made.

Furthermore, because the swinging members are caused to swing just by the interaction of permanent magnets and coils, unpleasant mechanical drive noises can be avoided, and delicate melodies can be accurately and faithfully produced.

DETAILED DESCRIPTION OF THE PREFERRED EMBODIMENTS

The preferred embodiments of the invention will now be described, with reference to the accompanying drawings.

Figure 2:
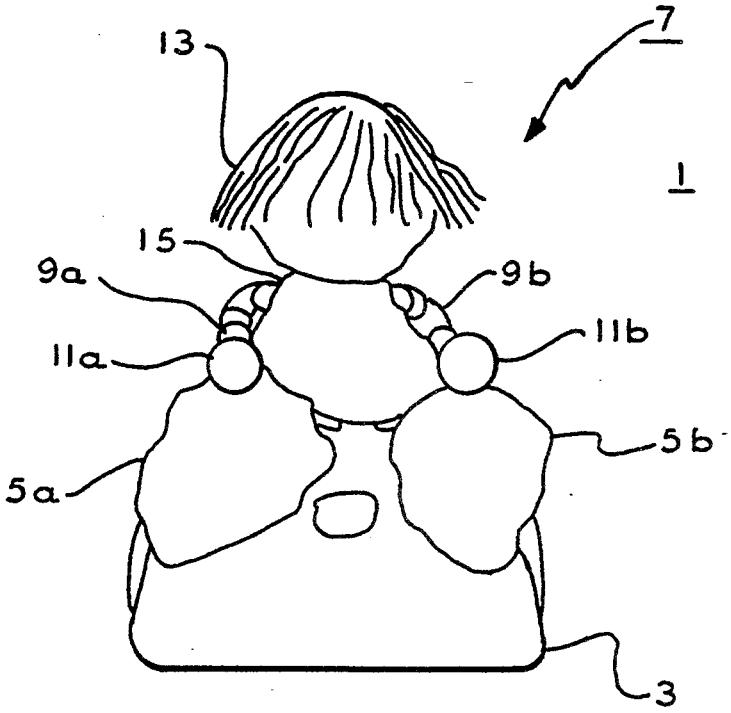
FIG. 2 is a perspective view of the exterior of the musical toy shown in FIG. 1.

First, the overall construction will be explained, with reference to FIG. 2.

A musical toy 1 is made up of a pedestal 3, a pair of sound producing bodies 5*a* and 5*b*, and a toy body 7. The pedestal 3 contains a control device, which will be explained hereinafter. The sound producing bodies 5*a* and 5*b* are made of plastic or the like formed into some suitable shape such as a bone or shell shape. The toy body 7 is made of plastic or the like formed into a doll shape, and the arms 9*a*, 9*b* are attached so that they are free to swing. The ends of these arms 9*a*, 9*b* are fitted with tappers 11*a*, 11*b*. The sound producing bodies 5*a*, 5*b* are positioned so that they are in the paths of the tappers 11*a* and 11*b*, so that when the arms 9*a* and 9*b* swing, the tappers 11*a* and 11*b* fitted to the ends of the arms, strike the sound producing bodies 5*a* and 5*b*. A head 13 is attached to a trunk part 15 by a spring so that when the arms 9*a* and 9*b* swing, the head 13 rocks to and fro. The trunk part 15 consists of a cover which is removably attached to the toy body 7.

Figure 1:
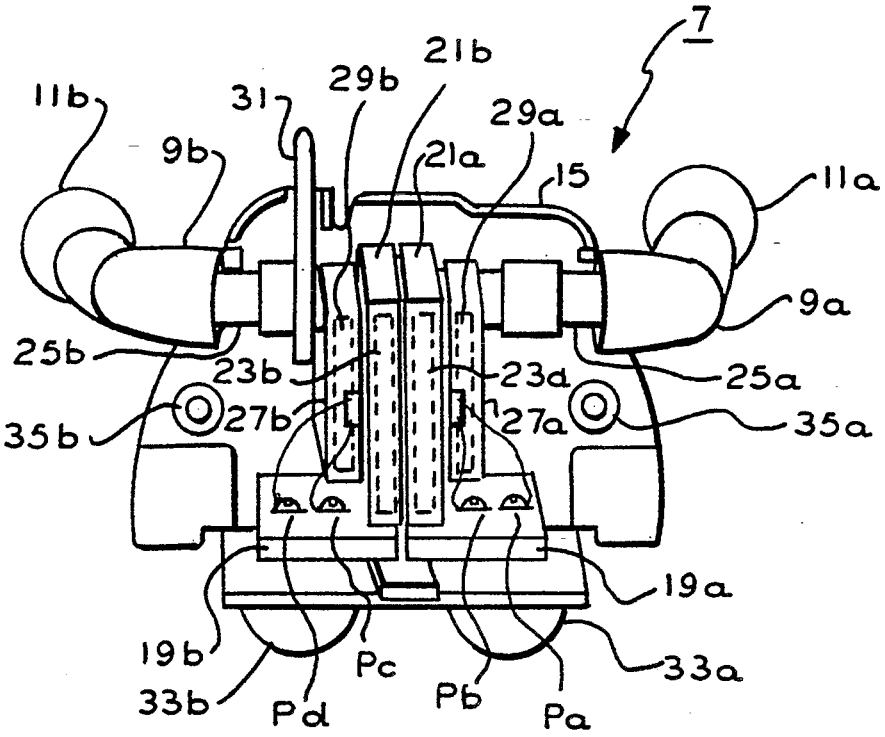
FIG. 1 is a perspective view of a musical toy in accordance with a first preferred embodiment of the present invention especially when taken from the rear of the main parts thereof.

The construction of the internal parts of the toy body 7 will now be described with reference to FIG. 1.

Base plates 19*a* and 19*b* are mounted on the bottom of the toy body 7, and cases 21*a* and 21*b*, made from plastic or the like, are mounted on the base plates 19*a* and 19*b*. These cases 21*a* and 21*b* are positioned approximately centrally in the toy body 7.

Figure 4:
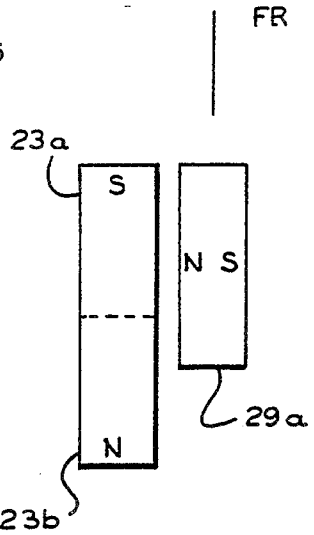
FIG. 4 is an explanatory diagram showing the magnetic interaction between a right hand coil and permanent magnets used in the present invention.

The cases 21*a* and 21*b* each contain a permanent magnet 23*a* in the front part and a permanent magnet 23*b* in the rear part, as shown in FIG. 4. A supporting shaft 25*a* is rotatably fitted horizontally near the top of the right hand face of the right hand case 21*a*, and another supporting shaft 25*b* is similarly rotatably fitted horizontally near the top of the left hand face of the left hand case 21*a*. Cases 27*a* and 27*b*, made from plastic or the like, are fixed to the shafts 25*a* and 25*b*, and these cases 27*a* and 27*b* contain coils 29*a* and 29*b*. These coils 29*a* and 29*b* are positioned close to the permanent magnets 23*a* and 23*b* so that the coils 29*a* and 29*b* interact magnetically with the permanent magnets 23*a* and 23*b* so that the cases 27*a* and 27*b* are caused to swing with the above-mentioned shafts 25*a* and 25*b* as axes. The base plates 19*a* and 19*b* are provided with connectors Pa, Pb and Pc, Pd, respectively, and the coil 29*a* is connected to the connectors Pa, Pb and the coil 29*b* is connected to the connectors Pc, Pd. These connectors are electrically connected to the control device mounted in the pedestal 3. The control device supplies separate and independent drive signals to each of the coils 29*a* and 29*b* so as to cause the cases 27*a* and 27*b* to swing independently of each other.

The arm 9*a* and the tapper 11*a* are fitted to the end of the shaft 25*a*, and the arm 9*b* and the tapper 11*b* are fitted to the end of the shaft 25*b*. Also, a bar member 31 is fixed to the shaft 25*b* near the case 27*b*, pointing upward so that the upper end of this bar member 31 causes the head 13 to rock to and fro when the bar member 31 swings along with the shaft 25*b* to which it is fixed.

Thus is formed one swinging assembly, consisting of the shaft 25*a*, the case 27*a*, the arm 9*a*, and the tapper 11*a*, and another swinging assembly, consisting of the shaft 25*b*, the case 27*b*, the arm 9*b*, and the tapper 11*b*.

A pair of leg parts 33*a* and 33*b* are provided on the base of the toy body 7, and the toy body 7 is fixed to the pedestal through these leg parts 33*a* and 33*b*. The trunk part 15 is provided with a pair of fastener holes 35*a* and 35*b*, and the back cover (not shown in the drawing), is provided with a matching pair of fastener projections, and the back cover is removably attached to the toy body 7 by the mating of these fastener projections with the fastener sockets 35*a* and 35*b*.

Figure 3:
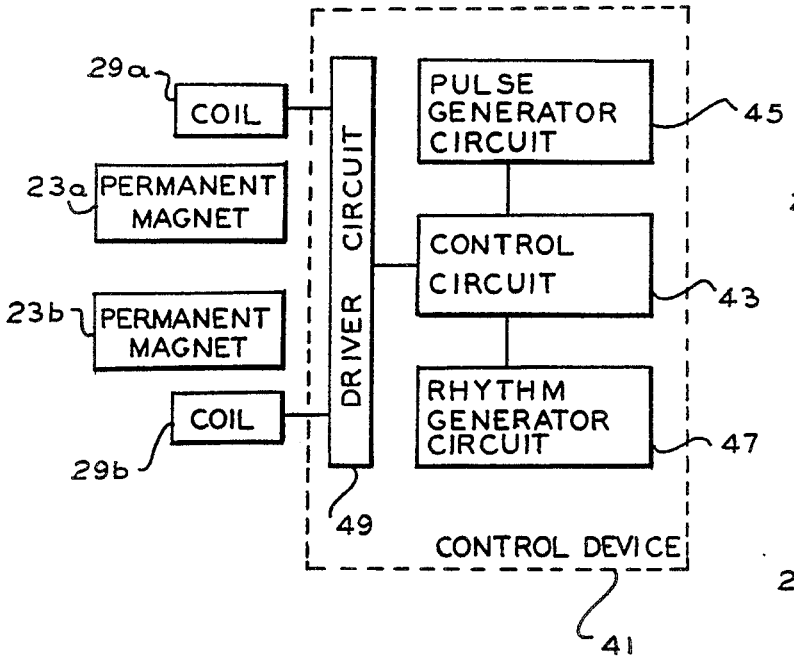
FIG. 3 is a block diagram of a control device and parts peripheral to the control device used in the present invention.

Next, the circuit construction of a control device 41 will be described, with reference to FIG. 3.

The control device 41 is made up of a control circuit 43, a pulse generator circuit 45, a rhythm generator circuit 47, and a driver circuit 49. The control circuit 43 has a calculation handling device such as a microcomputer (CPU), and performs various calculations. The pulse generator circuit 45 generates a rectangular pulse of fixed cycle and outputs this pulse signal to the control circuit 43. The rhythm generator circuit 47 is a rhythm signal generating means for generating a suitable rhythm signal. The control circuit 43 creates a rhythm drive signal based on the signal from the rhythm signal generator circuit 47. The drive circuit 49 is connected to the control circuit 43 and is also connected to the pair of coils 29*a* and 29*b*. The drive circuit 49 is a rhythm signal supplying means, and supplies pulse-form rhythm drive signals to each of the coils 29*a* and 29*b* independently in response to signals from the control circuit 43.

The control device 41 can be mounted in any suitable position in the toy body 7 or elsewhere.

The operation of this preferred embodiment will now be explained.

Figure 5:
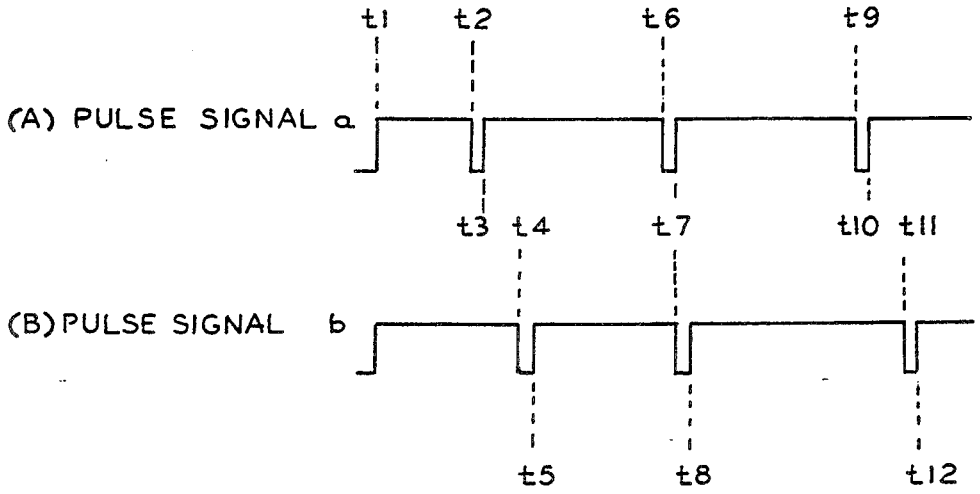
FIG. 5 is a waveform diagram of the pulse signals supplied to the coils.

The control circuit 43 inputs the fixed cycle rectangular pulses from the pulse generator circuit 45 and inputs the rhythm signals from the rhythm generator circuit 47, and creates rhythm drive signals by controlling the rectangular pulse output timing according to the rhythm signals. These rhythm drive signals are supplied through the drive circuit 49 to the coils 29*a* and 29*b*. For example, a pulse signal 'a' might be supplied to the coil 29*a*, and a pulse signal 'b' might be supplied to the coil 29*b*, where the signals 'a' and 'b' are as shown in FIG. 5.

First, the case in which a pulse signal 'a' of the kind shown in FIG. 5 (A) is output from the drive circuit 49 to the coil 29*a* will be described.

At time t1, when a positive pulse is outputted to the coil 29*a*, magnetic poles are created at the sides of the coil 29*a* according to the direction of the current flow through the coil 29*a*. At this point, supposing that at the left side of the coil 29*a* as shown in FIG. 4, in other words the side facing the permanent magnets 23*a* and 23*b*, an N magnetic pole is created, the N pole of the coil 29*a* and the N pole of the permanent magnet 23*b* will repel each other. As a result, the coil 29*a* will move in the forward direction FR and cause the case 27*a*, fixed to the shaft 25*a*, to swing. When this case 27*a* swings in the forward direction FR, the arm 9*a* and the tapper 11*a*, fixed to the shaft 25*a*, swing as one body, and the arm 9*a* and the tapper 11*a* are lifted up.

Then, at time t2, when the pulse signal drops to the L level, because the current flowing through the coil 29*a* is cut off, the magnetic poles formed by the coil 29*a* cease to exist. As a result, the arm 9*a* and the tapper 11*a*, raised up as described above, then swing down under the influence of their own weight. When the arm 9*a* swings down, the tapper 11*a* strikes the sound producing body 5*a* and creates a sound. And so on and so forth the operation described above is repeated, with the tapper 11*a* striking the sound producing body 5*a* and making a sound every time the pulse signal 'a' drops to the L level.

Next, the case in which a pulse signal 'b' of the kind shown in FIG.5 (B) is output from the drive circuit 49 to the coil 29*b* will be described.

Figure 6:
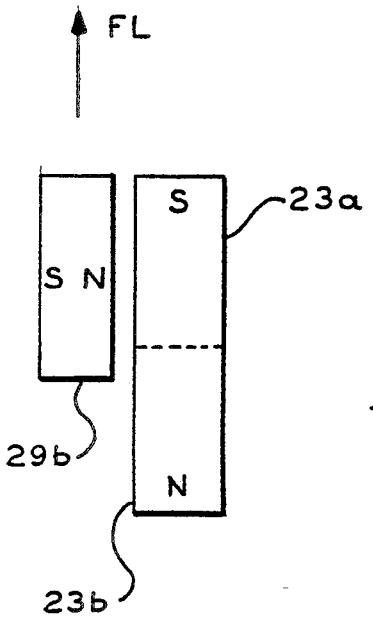
FIG. 6 is an explanatory diagram showing the magnetic interaction between a left hand coil and the permanent magnets.

At time t1, when a positive pulse is outputted to the coil 29*b*, magnetic poles are created at the sides of the coil 29*b* according to the direction of the current flow through the coil 29*b*. At this point, supposing that at the right side of the coil 29*b* as shown in FIG. 6, in other words the side facing the permanent magnets 23*a* and 23*b*, an N magnetic pole is created, the N pole of the coil 29*b* and the N pole of the permanent magnet 23*b* will repel each other. As a result, the coil 29*b* will move in the forward direction FL and cause the case 27*b*, fixed to the shaft 25*b*, to swing. When this case 27*b* swings in the forward direction FL, the arm 9*b* and the tapper 11*b*, fixed to the shaft 25*b*, swing as one body, and the arm 9*b* and the tapper 11*b* are raised up.

Then, at time t4, when the pulse signal drops to the L level, the arm 9*b* and the tapper 11*b*, raised up as described above, swing down under the influence of their own weight. When the arm 9*b* swings down, the tapper 11*b* strikes the sound producing body 5*b* and creates a sound.

And so on and so forth the operation described above is repeated, with the tapper 11*b* striking the sound producing body 5*b* and making a sound every time the pulse signal 'b' drops to the L level.

As described above, every time either of the pulse signals 'a' or 'b' drops to the L level, the respective tapper 11*a* or 11*b* strikes the respective sound producing body 5*a* or 5*b* and makes a sound.

Thus, when pulse signals like the pulse signals 'a' and 'b' shown in FIG. 5 are supplied to the coils 29*a* and 29*b*, the sound producing bodies 5*a* and 5*b* produce a rhythmical sound tan, tan, ta, ta, tan, tan, . . . '

Of course, by adjusting the output timing of each of the pulse signals 'a' and 'b' supplied by the control device 41, a suitable subtle rhythmical sound can be created.

Moreover, because no motor or mechanical drive transmission parts are used, and the swinging bodies are caused to swing just by the magnetic interaction of permanent magnets and coils, assembly is simple, and the whole toy can be made small.

Also, because the pulse signals supplied to the coils 29*a* and 29*b* are created according to a suitable rhythm sound, the toy can be accurately and easily made to produce any desired subtle rhythmical sound, and the toy can thereby be made fun and interesting.

In the preferred embodiment described above, a construction in which two permanent magnets 23*a* and 23*b* are positioned approximately centrally in the toy body 7 is used, but alternatively a construction using a single permanent magnet may be used. In this case, the poles of the permanent magnet are lined up in the front-rear direction and the coils 29*a* and 29*b* are given the appropriate magnetic pole orientation by suitable control of the direction of the current flow through the coils.

Also, although, in the example shown in FIG. 5, pulse signals 'a' and 'b' consisting of positive pulses are used for the drive signals and the sound is produced by the tappers striking the sound producing bodies when the swinging assemblies fall under their own weight when the pulse signals 'a' and 'b' drop to the L level, this invention is not limited to this design and in fact any suitable pulse signals can be used for the drive signals. For example, a pulse signal made up of both positive and negative pulses can be used as the drive signal. In this case, when a negative pulse is supplied, the swinging body is forcibly swung down and the tapper is under forced action when it strikes the sound producing body, so the musical toy can be given a positive, reliable action.

Now a second preferred embodiment of the invention will be described, with reference to FIG. 7 through FIG. 10.

Figure 7:
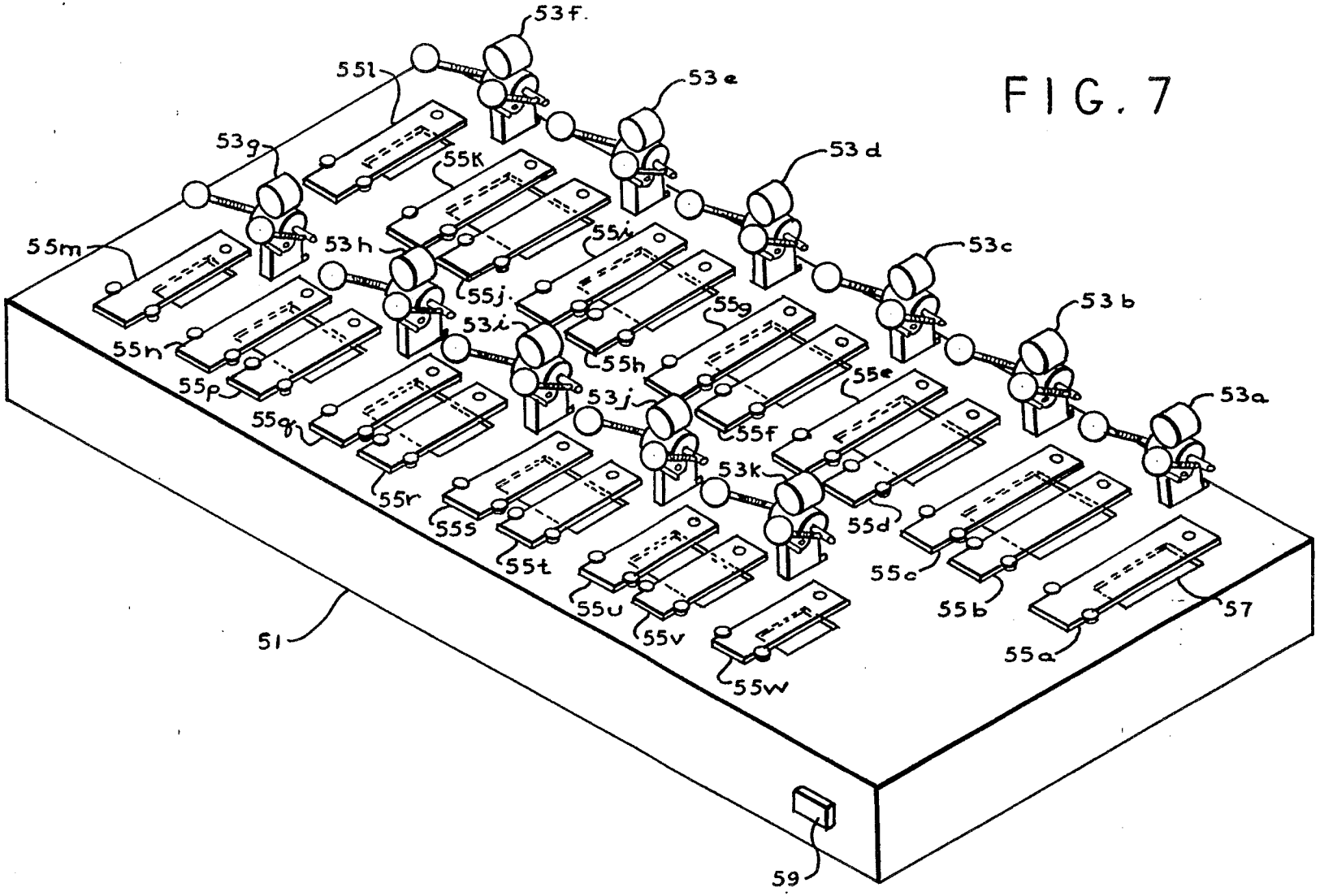
FIG. 7 is a perspective view of the exterior of a musical toy in accordance with a second preferred embodiment of the invention.

First, the overall construction will be explained, with reference to FIG. 7.

A musical toy 51 is made up of a plurality of toy bodies 53*a*, 53*b*, . . . , and a plurality of sound producing bodies 55*a*, 55*b*, 55*c*, 55*d*, . . . , corresponding to a plurality of musical notes, mounted on a box, and a control device 90 mounted inside the box. Each of the toy bodies 53*a*, 53*b*, . . . , has a pair of swinging assemblies. Each of the sound producing bodies 55*a*, 55*b*, 55*c*, 55*d*, . . . , is mounted in a position such that it is struck by one of the swinging assemblies of one of the toy bodies 53*a*, 53*b*, . . . , when it swings. For example, the sound producing bodies 55*a* and 55*b* are positioned so that they will each be struck by one of the swinging assemblies of the toy body 53*a*, and the sound producing bodies 55*c* and 55*d* are positioned so that they will each be struck by one of the swinging assemblies of the toy body 53*b*. The sound producing bodies 55*a*, 55*b*, 55*c*, 55*d*, . . . , are selected and arranged so that they form some kind of musical scale, for example, 'doh,' 'ray,' 'me,' 'far,'. . . , and a resonance opening 57 is provided beneath each sound producing body or pair of sound producing bodies. These openings make it possible for strong sounds to be produced by the sound producing bodies 55*a*, 55*b*, 55*c*, 55*d*, . . .

Operating switches 59 are provided in the side of the box of the musical toy 51.

Next, the internals of the plurality of toy bodies 53*a*, 53*b*, . . . , will be explained using the toy body 53*a* as a representative example.

Figure 8:
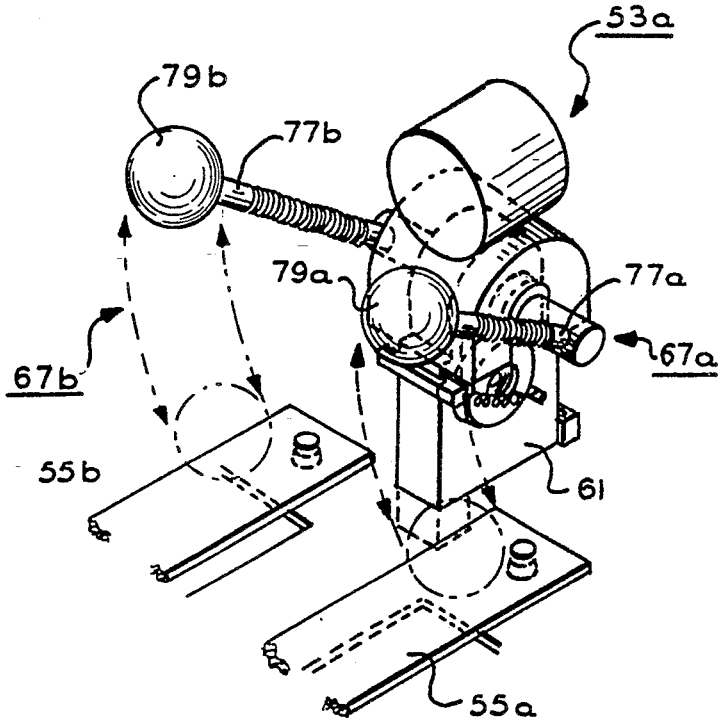
FIG. 8 is a perspective view of a toy body used in the preferred embodiment shown in FIG. 7.
Figure 9:
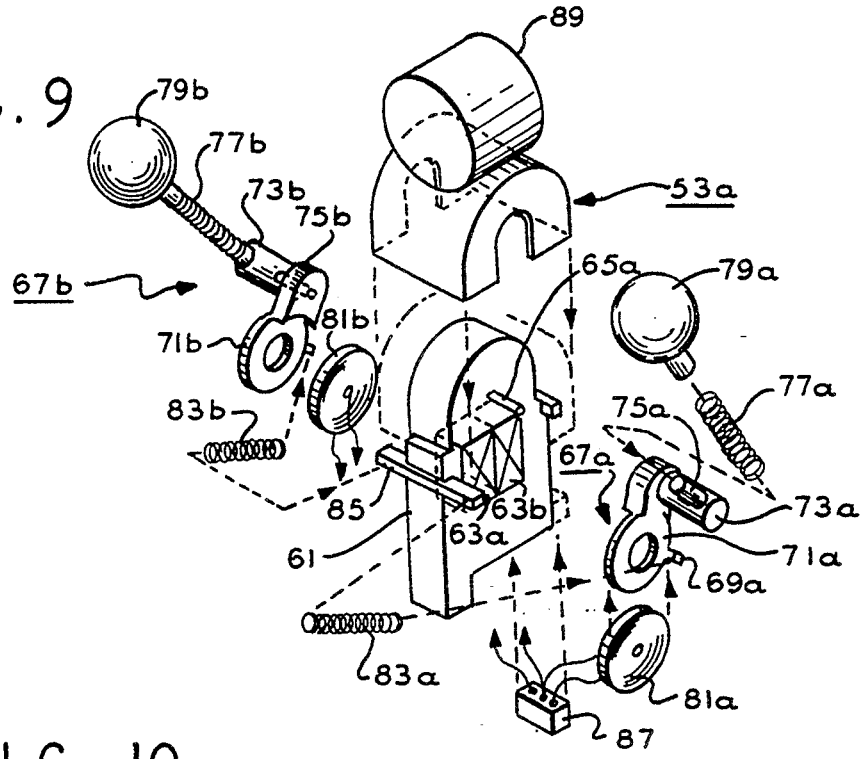
FIG. 9 is an exploded view of the assembly of the toy body shown in FIG. 8.

FIG. 8 is a perspective view of the toy body 53*a*, and FIG. 9 is an exploded perspective view of the toy body 53*a*. A case 61 is located in the central part of the toy body 53*a*, and inside the case 61 is a pair of permanent magnets 63*a* and 63*b*. A pair of swinging assemblies 67*a* and 67*b* are pivotally mounted close to the permanent magnets 63*a* and 63*b*.

The swinging assembly 67*a* consists of a coil receptacle 71*a*, a shaft 73*a*, a supporting stump 75*a*, a spring 77*a*, a tapper 79*a*, and a coil 81*a*. Specifically, a supporting shaft 65*a* is embedded in the right hand face of the upper part of the case 61, and the swinging assembly 67*a* is pivotally mounted on the supporting shaft 65*a*. The swinging assembly 67*a* includes a coil receptacle 71*a*, a supporting shaft 73*a* fixed to the coil receptacle 71*a*, and a supporting stump 75*a* fixed to the supporting shaft 73*a*. A tapper 79*a* is attached to the supporting shaft 75*a* by a spring 77*a*. A coil 81*a* is fixed in the coil receptacle 71*a*. The coil 81*a* causes the swinging assembly 67*a* to swing, by magnetically interacting with the permanent magnets 63*a* and 63*b*. A spring 83*a* stretches between a projection 69*a* embedded in the coil receptacle 71*a* and a stopper 85 fixed to the case 61, so that the elastic force of the spring pivots the swinging assembly 67*a* in the clockwise direction and the tapper 79*a* is held aloft. The angle through which the swinging assembly pivots in the clockwise direction is limited by the stopper 85.

The swinging assembly 67*b* mounted on the left side of the case 61 is similar to the swinging assembly 67*a* described above, and so a detailed description of the swinging assembly 67*b* will be omitted. A connector 87 is fixed to the lower part of the case 61, and the coils 81*a* and 81*b* are connected to this connector 87. A cover 89 is fitted on the upper part of the case 61.

The other toy bodies 53*b*, 53*c*, . . . , are of identical construction to that of the toy body 53*a*, and so a detailed description of them will be omitted.

Figure 10:
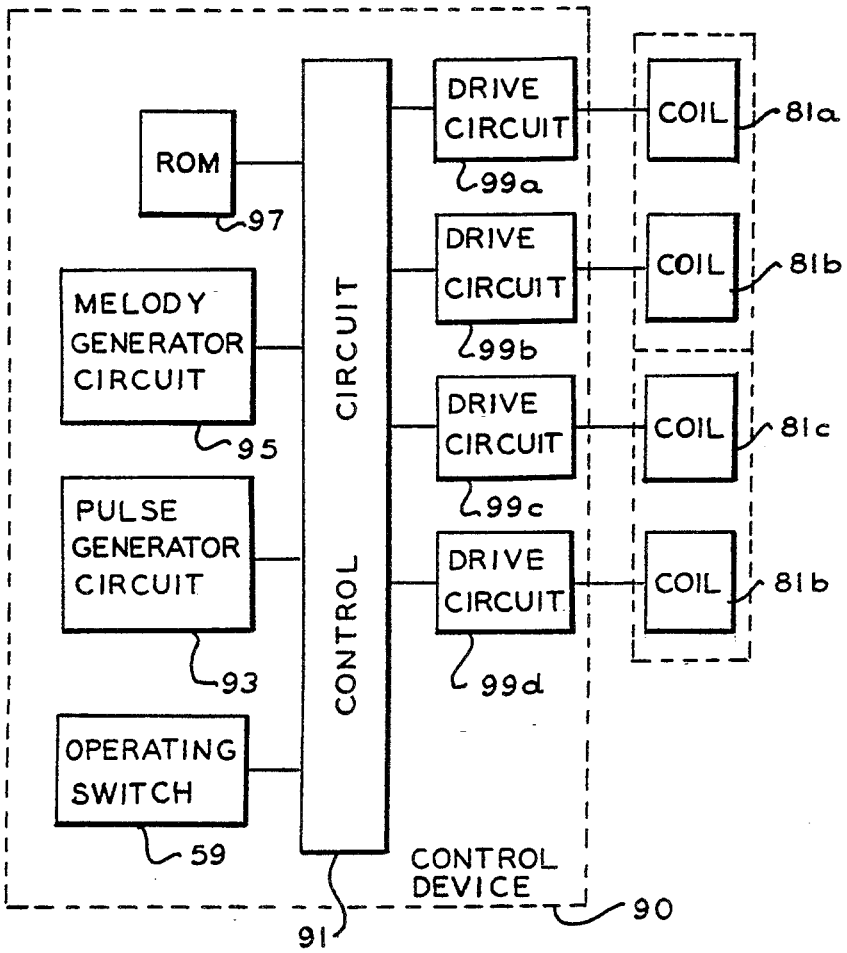
FIG. 10 is a block diagram of a control device, and parts peripheral to the control device, used in the preferred embodiment shown in FIG. 7.

Next, the circuit construction of the control device 90 will be described, with reference to FIG. 10.

The control device 90 consists of the operating switches 59, a control circuit 91, a pulse generator circuit 93, a melody generator circuit 95, a ROM 97, and drive circuits 99*a*, 99*b*, 99*c*, . . . . The operating switches 59 include a melody performance starting switch and a melody selection switch, and these switches 59 are connected to the control circuit 91. The control circuit 91 includes a calculation handling device such as a microcomputer (CPU), and performs various calculations. The pulse generator circuit 93 generates fixed cycle rectangular pulses and outputs pulse signals to the control circuit 91. The melody generator circuit 95 is a melody signal generating means for generating specific melody signals. The control circuit 91 generates melody drive signals based on the signals from the melody generator circuit 95 or the ROM 97. The drive circuits 99*a*, 99*b*, 99*c*, . . . , are connected to the control circuit 91 and are also connected to the respective coils 81*a*, 81*b*, 81*c*, . . . The drive circuits 99*a*, 99*b*, 99*c*, . . . , are a melody drive signal supplying means, and supply individual melody drive signals of pulse form to the respective coils 81*a*, 81*b*, 81*c*, . . . , in response to signals from the control circuit 91.

The ROM 97 contains other melodies, and these melody signals are read in from the ROM 97 according to the setting of the melody selection switch of the switches 59. The ROM 97 is therefore a melody signal generating means for generating melody signals. The ROM 97 is mounted in such a way that it can be removed and replaced, and by replacing the ROM 97 with another ROM, the musical toy can be made to perform a different selection of melodies.

When the starting switch of the switches 59 is switched to ON and the melody selection switch is not operated, a starting signal is outputted to the control circuit 91 and this activates the melody generator circuit 95. The control circuit 91 creates a melody drive signal for performing a specific melody based on the signal from the melody generator circuit 95. This melody drive signal for performing a specific melody is selectively divided up by musical note and the melody drive signal for each musical note is supplied through the respective drive circuit 99*a*, 99*b*, 99*c*, . . . , to the respective coil 81*a*, 81*b*, 81*c*, . . . .

For example, when performing a melody that goes 'doh,' 'ray,' 'me,' . . . , a melody drive signal for the 'doh' note is outputted through the drive circuit 99*a* to the coil 81*a*. After that, a melody drive signal for the 'ray' note is outputted through the drive circuit 99*b* to the coil 81*b*, and then a melody drive signal for the 'me' note is outputted through the drive circuit 99*c* to the coil 81*c*. When the coil 81*a* in the toy body 53*a* inputs the melody drive signal for the 'doh' note, magnetic interaction between the coil 81*a* and the permanent magnets 63*a* and 63*b* causes the swinging assembly 67*a* to swing. This causes the tapper 79*a* to swing downward against the elastic force of the spring 83*a* and strike the sound producing body 55*a*, producing a 'doh' note sound. And so forth as the respective coils in the toy bodies 53*a* and 53*b* input the melody drive signals for the 'ray' and 'me' notes, magnetic interaction with the respective permanent magnets causes the respective swinging assembly to swing and the respective tapper strikes the respective sound producing body. As a result, the plurality of sound producing bodies 55*b*, 55*c*, . . . , corresponding to the various notes, are struck in turn by their respective tappers and the 'doh,' 'ray,' 'me,' . . . , melody is played.

Because, as described above, the sound producing bodies are struck by the swinging assemblies which swing in response to the melody drive signals, specific melody sounds can be produced, and a fun and interesting toy can be made.

Also, by exchanging the ROM 97, the musical toy can be made to perform other melody selections.

Figure 11:
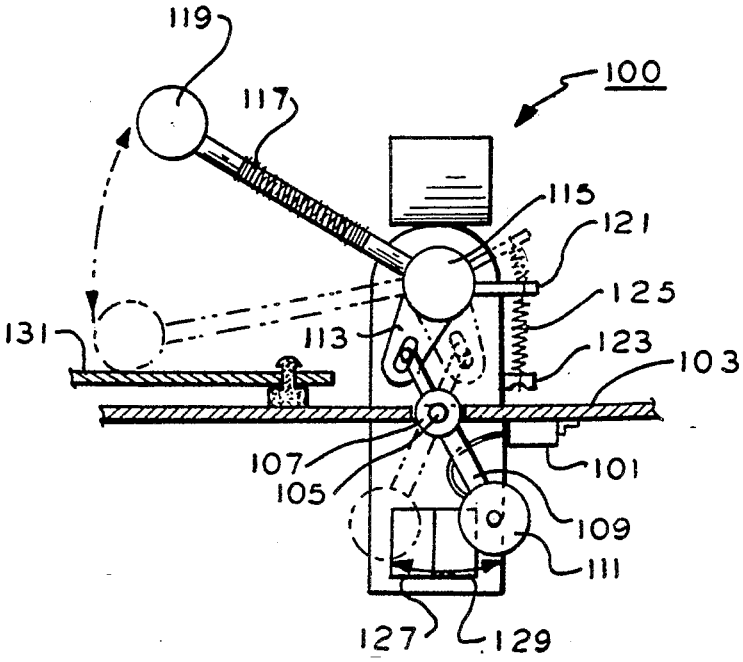
FIG. 11 is an explanatory view showing the mounting of another preferred embodiment of the toy body used in the preferred embodiment shown in FIG. 7.

Next, another preferred embodiment of the toy body part of the invention will be described, with reference to FIG. 11.

The toy body 100 of this preferred embodiment has the merit that the connector 101 is fitted in a place other than on the toy body, so that the process of assembly is made even more simple. A rotating part 107 is rotatably fitted onto a shaft 105 mounted approximately centrally on the side of the toy body 100, and an arm 109 is fixed to the rotating part 107. A coil 111 is fitted to the lower end of the arm 109. The upper end of the arm 109 interlocks with the lower end of another arm 113, and this arm 113 is fixed to another rotating part 115. This rotating part 115 is rotatably fixed to the shoulder part of the toy body 100. A tapper 119 is attached to the rotating part 115 by a spring 117. A projection 121 is fixed to the rotating part 115, another projection 123 is fixed to the toy body 100, and a spring 125 is stretched between the projection 121 and the projection 123. The elastic force of the spring 125 rotates the rotating part 115 clockwise so that the tapper 119 is raised aloft. The above-mentioned coil 111, the arm 109, the rotating part 107, the arm 113, the rotating part 115, the spring 117, and the tapper 119 make up one swinging assembly.

A pair of permanent magnets 127, 129 are positioned facing the coil 111 at the bottom of the toy body 100. The lower part of the toy body 100 is sunk into the case 103, and the coil 111 is electronically connected to a connector 101 fitted to the underside of the case 103. When a melody drive signal is fed to the coil through the connector 101, magnetic interaction between the coil 111 and the permanent magnets 127 and 129 causes the tapper 119 to swing down, and the tapper 119 strikes the sound producing body 131.

By fitting the connector 101 to the case 103 as described above, the wiring connecting the coil 111 at the side of the toy body 100 to the control device is simplified, and the assembly process is made simpler.

Also, because the coil 111 in the side of the toy body 100 is connected to the control device through the connector 101 fitted to the case 103, fitting and exchanging of the toy body 100 can be carried out easily.

The connector 101 can be fitted in a suitable location on a circuit board or the like. As described above, the first of the means which make up this invention has a swinging member pivotally mounted near to a permanent magnet, and this swinging member is provided with a coil which by magnetically interacting with the permanent magnet causes the swinging member to swing. Because a control device has a rhythm signal generating means for generating rhythm signals and a drive signal supplying means for supplying drive signals to the coil based on the signal from the rhythm signal generating means, and a sound producing body is struck by the swinging member swinging in response to rhythm signals, sounds having a specific rhythm and tempo can be produced and a fun and interesting device can be made.

Also, because no motor or mechanical drive transmission parts are used, and the swinging members are caused to swing just by the action of permanent magnets and coils, the invention has the merit that its simple construction allows the assembly process to be made simple.

The second of the means which make up this invention has a plurality of toy bodies; a control device; and a plurality of sound producing bodies for producing a plurality of different musical notes.

Permanent magnets are provided in each of the toy bodies and swinging members are pivotally mounted near to the permanent magnets. These swinging members are each provided with a coil which causes the swinging member to swing by magnetically interacting with the permanent magnets. Because the control device has a melody signal generating means for generating melody signals and a drive signal supplying means for supplying separate and independent drive signals to each of the coils based on the signal from the melody signal generating means, and the sound producing bodies are struck by the swinging members swinging in response to melody signals, sounds having a specific melody can be produced and a fun and interesting device can be made.

And, because the swinging members are caused to swing just by the interaction of permanent magnets and coils, unpleasant mechanical drive noises can be avoided and delicate melodies can be accurately and faithfully produced. Furthermore, assembly is simple and miniaturization of the whole toy is possible.

What is claimed is:

1. A musical toy, comprising:

(a) a toy body including a toy head mounted movably thereon and a sound producing body;

(b) a permanent magnet disposed in the toy body, a swinging member pivotally mounted on the toy body in close proximity to the permanent magnet and a head engaging member mounted on the swinging member;

(c) an electromagnetic coil, mounted on the swinging member, for causing the swinging member to swing by magnetically interacting with the permanent magnet;

(d) a control device including rhythm signal generating means for generating rhythm signals, pulse generator circuit means for producing pulse signals, control circuit means for receiving the pulse signals and the rhythm signals and in response thereto for producing rhythm drive signals, drive circuit means for receiving and supplying the rhythm drive signals to the coil;

wherein the swinging member swings in response to the rhythm drive signals and the sound producing body is positioned such that it is struck by the swinging member when the swinging member swings to produce sound and the head engaging member strikes and moves the head in concert with the sound.

2. A musical toy, comprising:

(a) a plurality of toy bodies, and a plurality of sound producing bodies which produce a plurality of different musical notes;

(b) a permanent magnet, and a swinging assembly mounted in close proximity to the permanent magnet, disposed on each of the toy bodies;

(c) each swinging assembly including an electromagnetic coil receiving member mounted pivotally to each toy body, an electromagnetic coil mounted on each coil receiving member for causing the coil receiving member to swing by magnetically interacting with the respective permanent magnet, each coil corresponding to one of the musical notes, each swinging assembly further including a tapper for striking one of said sound producing bodies, a spring and interconnecting means connected to said coil receiving member, said tapper connected to said interconnecting means by said spring;

(d) a control device including a microcomputer, pulse generator circuit means for generating and supplying pulse signals to the microcomputer, melody signal generating means for generating melody signals made up from a plurality of different musical notes and for supplying the melody signals to the microcomputer, drive signal supply means, the microcomputer for supply drive signals to the drive signal supply means in response to the pulse signals and the melody signals and the drive signal supplying means for supplying a drive signal for each musical note, based on the signal from the melody signal generating means, to the coil corresponding to that musical note;

wherein the coil receiving members swing in response to their respective melody drive signals and impart swinging movement to the tappers through the interconnecting means and the springs and wherein the sound producing bodies are positioned such that they are struck by the swinging tappers corresponding to their respective musical notes.

3. The musical toy according to claim 2 wherein said interconnecting means include a shaft extending outwardly from said coil receiving member and a supporting stump extending outwardly from said shaft, one end of said spring mounted to said supporting stump and the other end of said spring mounted to said tapper.

4. The musical toy according to claim 2 wherein said coil receiving member includes first interconnecting means, wherein said swinging assembly further includes an arm mounted pivotally on said body and said arm including second interconnecting means and a supporting stump, said first and second interconnecting means interconnected to cause said coil receiving member to pivot said arm through said first and second interconnecting means upon said coil receiving member being pivoted, one end of said spring mounted to said supporting stump and the other end of said spring mounted to said tapper.

5. The musical toy according to claim 2 wherein each of said toy bodies is provided with stop limit means for limiting the pivot angle through which said tappers swing to strike said sound producing bodies.

6. The musical toy according to claim 5 wherein said stop limit means comprise a stopper bar mounted on each of said toy bodies.

* * * * *